US005363903A

United States Patent [19]

Hagar

[11] Patent Number: 5,363,903

[45] Date of Patent: Nov. 15, 1994

[54] PERIMETER SEAL FOR AIR HEATER

[75] Inventor: Donald K. Hagar, Emmaus, Pa.

[73] Assignee: Damper Design, Inc., Bethlehem, Pa.

[21] Appl. No.: 92,902

[22] Filed: Jul. 19, 1993

[51] Int. Cl.[5] ..... F23D 19/04

[52] U.S. Cl. ..... 165/9; 165/8

[58] Field of Search ..... 165/9, 4, 8

[56] References Cited

U.S. PATENT DOCUMENTS

| | | | |
|---|---|---|---|
| 2,517,512 | 8/1950 | Tigges et al. | 165/9 |
| 2,744,731 | 5/1956 | Brandt | 165/9 |
| 2,761,654 | 9/1956 | Valvo | 165/9 |
| 3,323,579 | 6/1967 | Brandt et al. | 165/4 |
| 4,088,146 | 5/1978 | Hagar . | |
| 4,669,531 | 6/1987 | Conde | 165/9 |
| 4,673,026 | 6/1987 | Hagar et al. | 165/9 |

*Primary Examiner*—Albert W. Davis, Jr.

*Attorney, Agent, or Firm*—Foley & Lardner

[57] ABSTRACT

An air heater perimeter seal provides independent positive control of the leak path induced by relative radial and axial movements at the rotor perimeter. A seal member with a relatively wide seal face disposed in a plane perpendicular to the air heater axis allows the seal member to stay within the radial width of the corresponding seat during expansion and contraction of the rotor as it moves from the air side to the discharge gas side and back. In addition, the installation adjustability and the tolerance for radial error of the seal of the present invention makes it possible for out-of-round rotors and warped housings to be properly sealed. An axial slip joint between the seal member and the rotor allows the seal face to remain adjacent to the face of the sector place and to the seat face regardless of rotor droop. The axial slip joint also acts as a labyrinth seal to control leakage of gasses between the housing and rotor.

7 Claims, 6 Drawing Sheets

PERIMETER SEAL FOR AIR HEATER

BACKGROUND OF THE INVENTION

1. Field of the Invention

This invention relates to the field of sealing systems for air heaters and more particularly to sealing systems at the circumferential interfaces between the rotatable and stationary elements of rotary regenerative heat exchangers.

2. Discussion of the Related Art

It is typical in fuel burning installations, such as electrical power generating plants, to use rotary regenerative air heaters for preheating the intake air to improve the efficiency of the fuel burning operation. These air heaters typically include two main elements or components, the first main element being a generally cylindrical drum, which carries a matrix of heat exchange elements, called baskets; the second main element being a housing having a generally cylindrical opening, in which housing the drum is located.

In the most common type of air heater, the Ljungstrom type, the drum takes the form of a rotor and the housing is stationary, such that the drum or rotor is rotatably mounted in the stationary housing. Another type of air heater uses a stationary drum containing the heat exchange elements and a movable housing surrounding the drum. This type of air heater is known as a Rothermuhle type air preheater, which is exemplified in U.S. Pat. 3,802,489 assigned to Apparatebau Rothermuhle Brandt & Kristzler of Wenden, West Germany, the disclosure of which patent is incorporated herein by reference.

As indicated, however, the most commonly used air heaters are those of the Ljungstrom type in which the drum is a cylindrical rotor containing metallic heat transfer plates, the rotor being movable with respect to a surrounding stationary housing. As the rotor turns, the heat transfer plates are first exposed to hot discharge gases, e.g. flue gases, and these heated plates then move into the air intake passage to heat the incoming air. The housing surrounding the drum includes sector plates which divide the housing into an air intake half and gas discharge half. To limit leakage between the drum and housing, the drum is typically provided with circumferentially extending, semi-rigid seal plates that are intended to pass closely by the annular wear bar in the housing with only a small clearance.

A major problem with the foregoing sealing arrangement is that it depends on achieving small, constant and predictable clearances between the seal plates and adjacent surfaces. Such clearances are difficult to attain even in a newly manufactured air preheater, and are particularly difficult to maintain in an air preheater that is in service. Air preheaters, when in service, are subject to extremes in temperature and are subject to a very hostile environments. Factors such as wear, distortion of parts due to temperature differentials, normal dimensional changes due to heating and cooling, irregular surfaces on the wear bars, out-of-roundness of the rotor and/or adjacent housing portion, and various other factors contribute, in practice, to wide variation in the clearances between the main elements which move relative to each other.

One particular problem is that the rotor and its seal plate tend to droop when heated, the hotter end of the rotor assuming a convex shape and the less hot end a concave shape. This, in turn, may result in excessive clearances at one end of the air heater and may also result in a complete lack of clearance at the other end, such there is an unintentional clashing of the metal seal plates with the adjacent sealing surfaces. These problems are further aggravated by the hostile environment to which an air preheater is subjected. The dirty, soot and acid-laden discharge gas which passes through the air preheater results in soot buildup, corrosion, and wear, all of which contribute to irregularities in the relatively movable parts. The irregularities, of course, lead to sealing difficulties.

As indicated, the circumferential seals which are original equipment in Ljungstrom type air heaters include semi-rigid plates mounted in close proximity to stationary sealing surfaces in the housing. These sealing surfaces, may, for example, be provided by annular wear bars mounted in the housing. Each stationary sealing surface expands and contracts with temperature changes, so its diameter changes along with the temperature changes. Thus, the clearance between the end of the semi-rigid seal plate and the sealing surface is subject to wide variation, resulting in significant leakage. The leakage is tantamount to a bypass around the air heater, and it reduces the efficiency of the plant. To control and minimize this leakage, the seals at the perimeter, i.e., the seals at the interface between the rotor and the housing, are the most critical of all the seals in terms of their effect upon overall plant performance.

Donald K. Hagar et al. U.S. Pat. Nos. 4,673,026 and 4,791,980, disclose radial and circumferential sealing arrangements which represent improvements over the semi-rigid radial and circumferential seal plates which are original equipment on Ljungstrom type air heaters. The present invention represents yet a further improvement in the circumferential sealing arrangement over that disclosed in the foregoing Hagar et al. patents, the disclosures of which are hereby incorporated herein by reference.

Circumferential seals, including the improved circumferential seals disclosed in the foregoing Hagar et al. patents have been the most service intensive of the seals in the air preheater. In view of their use of relatively thin strips of sealing material, the improved circumferential seals could be damaged when subject to severe conditions. Such improved seals left room for further improvement in terms of tolerance for out-of-roundness in the main, relatively rotatable elements of air heater. Despite the improvement they represented in reducing the chances of metal-to-metal clashing when normal clearances would disappear, such improved seals could still, under some circumstances, damage the surface with which they mated.

With these considerations in mind, the present invention seeks to provide a more efficient sealing mechanism which can be mounted on standard air heater structures, which structures may have main elements of significantly less than perfect cylindrical shape, i.e., air heater elements which have significant radial dimensional errors and which elements, during operation, may exhibit undesirable radial and axial displacements as well.

These undesirable radial and axial displacements occur both through shape and dimension changes caused by heating and cooling of the components of the air heater as well as basic, built-in location errors which are not necessarily temperature dependant. Thus, in addition to thermal displacements, it is not unusual to encounter significant built-in errors such as built-in out-of-roundness. Additionally, the thermal displacements result in a constantly changing radius for the rotor, making particularly challenging the task of providing a close tolerance seal, even with the improved circumferential seal disclosed in the foregoing Hagar patents.

SUMMARY

It is an object of the present invention to overcome the foregoing drawbacks and problems and to achieve those results and improvements indicated to be desirable in the foregoing discussion.

It is a related object of the present invention to provide a perimeter seal which is analogous in basic purpose to the circumferential seal of the foregoing Hagar et al. patents but which represents yet a further improvement over original equipment seals as compared with the circumferential seal of the foregoing Hagar et al. patents.

It is a related object of the present invention to provide a sealing arrangement for an air preheater which accommodates wide variations in clearances between the relatively moving main elements of the air heater.

It is a further object of the present invention to provide a sealing arrangement for an air heater which can accommodate growth and shrinkage of parts due to heating and cooling, which can accommodate highly corrosive acids without loss of sealing effect, and which can accommodate irregularities and built-in dimensional and positioning errors in the relatively movable elements of the air heater.

It is yet another object of the present invention to provide a sealing arrangement for an air heater, which sealing arrangement is highly effective and which reduces intermingling of gasses and lessens leakage around the periphery of the rotor to a minimum, thereby rendering the air heater, and thus the fuel burning operation, highly efficient.

It is a further object of the invention to provide a sealing arrangement for an air preheater which achieves demonstrable fuel savings as a result of improved efficiency in the exchange of heat between the discharge gasses and intake air of the fuel burning installation.

It is also an object of the present invention to provide a peripheral sealing arrangement for an air heater which is easy and economical to install.

It is a related object of the present invention to provide a peripheral sealing arrangement for an air heater which can readily be incorporated into air heaters which are already installed in the field or incorporated into new air heaters of standard design, with such incorporation being capable of accomplishment in a very simple manner with only a minimum of modification to the air heater.

It is yet another object of the invention to provide a perimeter seal for an air heater, which perimeter seal provides independent positive control of the leak path variations induced by relative radial and axial movements at the rotor perimeter.

It is also an object of the present invention to provide a perimeter seal in which a seal face stays within the width of the seal seat during expansion and contraction of the rotor as the rotor goes from exposure to air, to exposure to flue gas, and back to exposure to air.

Yet other objects of the present invention are to provide a perimeter seal which provides for a wide range of installation adjustability, to provide a perimeter seal which accommodates a wide range of radial errors in the rotor and housing and to provide a perimeter seal with which out-of-round rotors and warped housings can be properly sealed.

It is yet a further object of the present invention to provide a perimeter seal with an axially movable seal joint which allows a radial surface seal to remain adjacent to the face of the sector plate and corresponding seat regardless of rotor droop.

Further objects of the present invention include providing a perimeter seal requiring no adjustment after initial installation and which includes wide sealing surfaces with low contact loadings to provide long seal life.

It is yet another object of the present invention to provide a continuous perimeter seal for an air preheater, i.e., it is an object of the invention to seal an air preheater such that there are no discontinuities in the seal perimeter.

The foregoing and additional objects are obtained by a sealing structure for an air heater according to the present invention.

To achieve the foregoing objects, the present invention separates the radial and axial components of the displacements which occur through positioning and dimensioning errors and through thermal deflections in the region of the interface between the relatively movable main elements of the air heater, for example, between the rotor and surrounding housing. The present invention makes the sealing with respect to these radial and axial displacements totally independent of each other. Axial displacements are accommodated through a sliding leaf seal joint. Radial displacements are accommodated by a face seal having a wide enough face so that radial positioning or dimensioning errors or radial changes due to thermal expansion or contraction results simply in the mating surfaces being in slightly different relative radial locations.

The most common expected use for the present invention and the preferred embodiment of the present invention as disclosed herein, entails the seal assembly being clamped to the rotor, with the mating seat and related components being attached to the housing. This arrangement provides for the simplest installation, with the seat being disposed in a plane perpendicular to the central axis of the air heater. As the seal assembly travels around with the rotor, the seal face maintains a close clearance with respect to the seat. The arrangement is such that the seal face has substantial radial location freedom. Specifically, the seal face may move radially inwardly and outwardly next to the mating seat without losing the leakage control gap.

The seal face is also free to float axially relative to the rotor by virtue of an axially sliding labyrinth leaf seal joint. This joint is in the nature of a circumferentially disposed expansion joint using multiple plies of metallic strips forming a labyrinth which perform a sealing function. The axial freedom of movement provided by the joint ensures that the seal face does not move away from the seat or bind into the seat when the rotor deflects thermally.

To recapitulate and to further summarize the present invention in terms of its structure, the present invention provides a seal for an air heater, the air heater having first and second main elements. These two main elements are: 1) a rotatable element which rotates about a central axis of the air heater and 2) a stationary element which is coaxially disposed with respect to the rotatable element. In the preferred embodiment, the first, element, i.e., the rotatable element, is a rotor containing heat exchange elements or "baskets", and a second main element, i.e., the housing, is a stationary element which surrounds the rotor. As indicated, however, these elements may be reversed such that the heat exchange element is stationary and the housing rotates about the heat exchange element. In either case, the rotatable and stationary main air heater elements are coaxially disposed with respect to each other. Air heaters of either type will have a leak path, along which path gasses (e.g., air and flue gasses) may at times leak between the main air heater elements.

The seal of the present invention includes a seal member circumscribing the central axis of the air heater. The seal member has a seal face disposed in a plane perpendicular to the central axis of the air heater, and the seal member is coupled with the first main element of the air heater, e.g., the rotor. A seat also circumscribes the central axis of the air heater, the seat having a seat face disposed in a plane perpendicular to the central axis of the air heater. The seat is coupled with the second main element of the air heater, e.g., the housing. The seat face and the seal face are disposed in mutually opposed, face-to-face, cooperating relationship to effect sealing of the axial leak path of the air heater while also accommodating radial displacements and radial positioning variations between the rotatable and stationary main elements of the air heater.

The seal of the present invention also includes an axially movable joint, which may include sets of mutually interengaging leaf seal strips. The joint is coupled with the seal member and is disposed between the seal member and the first main element of the air heater, e.g., the rotor. The interengaging leaves or strips seal the joint against gas flow across the joint in a radial direction with respect to the central axis of the air heater. That is, the axially movable joint seals part of the leak path of the air preheater. The joint has freedom of axial movement to accommodate axial displacements and axial position variations as between the seal member and the first main air heater element, e.g., the rotor. This axial freedom of movement in turn, facilitates maintenance of the face-to-face sealing relationship between the seal face and the seat face.

The seal member includes a rear surface, which surface is disposed in a plane perpendicular to the central axis of the air heater. The rear surface faces away from the seal face of the seal member. A seal track, which has a track face also disposed in a plane perpendicular to the central axis of the air heater, cooperates with the rear surface of the seal member. The seal track is coupled with the second main element of the air heater, e.g., the housing. The rear surface and the track face are disposed in mutually opposed, face-to-face relationship for limiting the extent to which the seal member may move axially away from the seat.

The seat and the seal track are axially spaced from each other in parallel planes so as to form an annular gap between them. This annular gap extends between the seat face of the seat and the track face of the seal track. The seal member is disposed in the annular gap for accommodating relative rotational movement of the seal member with respect to the gap as the main air heater elements move relative to each other. In this way, the seal face of the seal member may engage the seat on one side of the gap or, alternatively, the rear surface of the seal member may engage the track face of the seal track on the other side of the gap. Engagement will depend upon direction and extent of relative axial displacements of the main air heater elements or will depend upon the direction and extent of axial positioning discrepancies of the main air heater elements to be accommodated.

In the preferred embodiment, the seal track is rigidly coupled to the housing in a position radially inwardly spaced from the housing by a set of track mounting clips extending radially between the seal track and the housing. The radial spacing of the seal track from the housing forms an open, annular space between the seal track and the housing to prevent accumulation of foreign material in the gap.

As indicated, the axially movable joint includes sets of overlapping strips of spring material, one set of strips being fixed at one side to the first main air heater element, e.g., the rotor, the other set of strips being fixed at one side with respect to the seal member. The other sides of the sets of strips are interengaged in mutually overlapping disposition to accommodate axial movement of the seal member with respect to the first main air heater element, e.g., the rotor, while at the same time providing a seal against leakage of gasses between the rotor and the housing.

A drag link mechanism extends between the seal member and the first main air heater element, e.g., the rotor, to rigidly fix the seal member against circumferential movement, i.e., circumferential slippage, with respect to the rotor, while allowing axial movement between the seal member and the rotor.

DETAILED DESCRIPTION OF THE PREFERRED EMBODIMENT

FIGS. 1–4 depict a conventional fuel burning arrangement with an air preheater to bring out the background and environment of the present invention. It will be understood that this depiction and discussion of the environment of the invention is for illustrative purposes only and that the invention may be used in other environments. For example, the invention may be used in other types of coal-fired combustion systems, as well as in systems with gas and oil-fired boilers.

Figure 1:
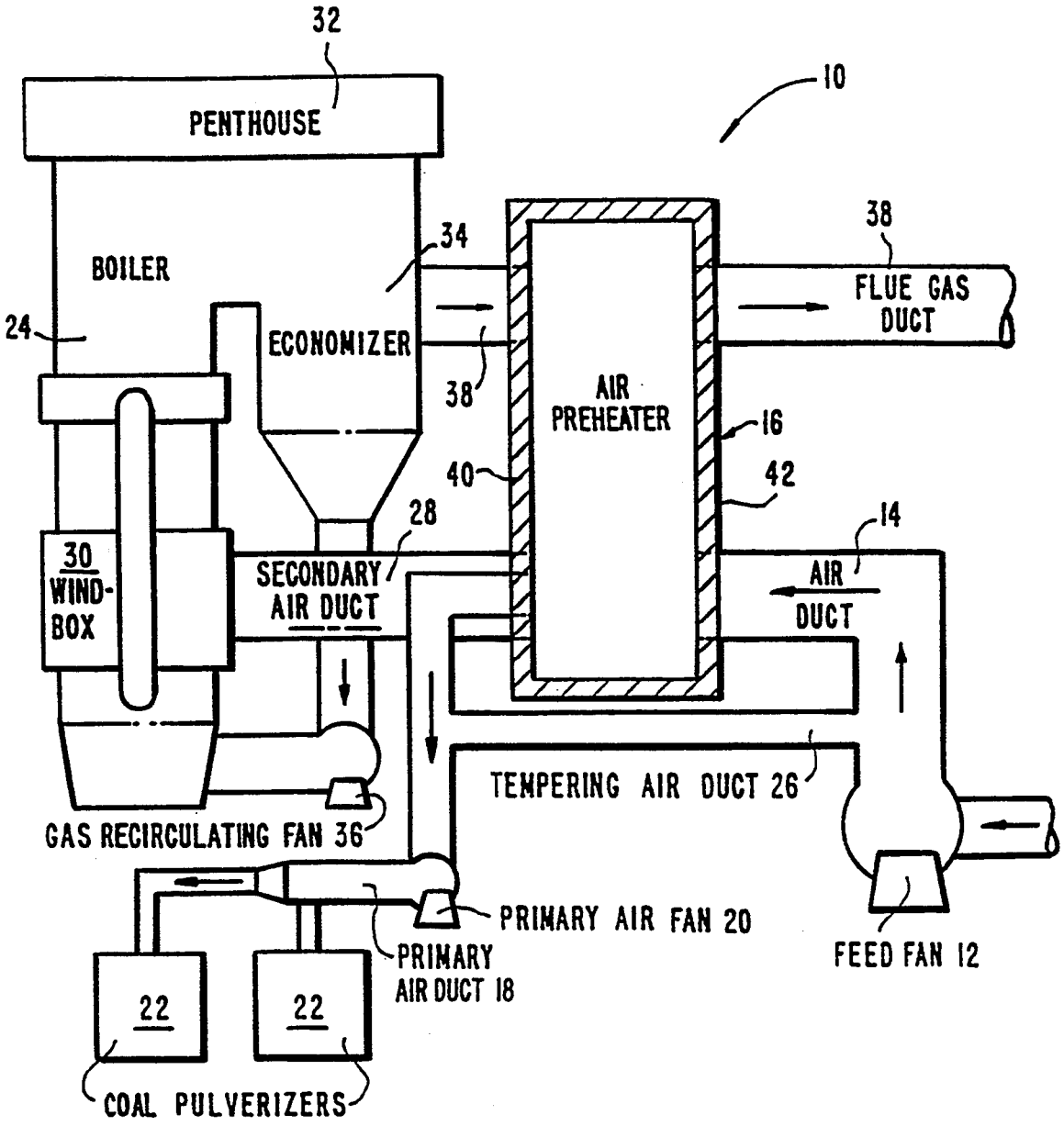
FIG. 1. (PRIOR ART)
FIG. 1 is a schematic illustration of a fuel burning facility showing a common environment for use of the air heater of the type to which the present invention is directed.

FIG. 1 depicts a fuel burning facility generally referred to by reference numeral 10. Fuel burning facility 10, as shown in FIG. 1, is of a type typically used in power plants for burning pulverized coal to produce steam which, in turn, will drive turbines to produce electricity. Intake air is fed into fuel burning facility 10 by a fan 12 via intake air duct or passage 14. This intake air is fed into one side of a conventional air heater generally referred to by reference character 16. Air heater 16 utilizes discharge flue gases to preheat the intake air flowing through duct 14. This preheating increases the efficiency of the fuel burning operation.

Downstream of the air preheater 16, primary air for entraining pulverized coal is tapped off from air duct 14 both downstream of the air preheater and also via a tempering air duct 26 which bypasses the air heater. Primary air passes through primary air duct 18, and its flow is boosted by a primary air fan 20, which feeds the primary air to coal pulverizers 22. The primary air entrains the pulverized coal and feeds it to the boiler 24.

Meanwhile, the remaining air which passes through the air preheater 16 continues on through the secondary air duct or passage 28 and then into the wind box 30. This is secondary air and is the air which supports combustion. The secondary air is fed to the boiler along with the pulverized coal entrained in primary air.

Above the boiler 24 is a penthouse 32, and downstream of the boiler is an economizer 34 which effects recirculation of gases via gas recirculation fan 36. The remainder of the flue gases are discharged via flue gas duct or passage 38, which passes through another side of the air heater 16 for preheating the cold intake air flowing in through air duct 14.

It will be noted that, as seen in FIG. 1, one-half of the right-hand end of the air heater receives cold intake air, and another half of the right-hand end discharges flue gases from which heat has been extracted. That is, the flue gas being discharged is cooled flue gas. Since both the air flowing into and the gas flowing out of the right-hand end of air preheater 16 (as viewed in FIG. 1) is relatively cool, that end is referred to as the cold end 42. By the same token, intake air flowing out of the left-hand end of the air preheater (as viewed in FIG. 1) will be relatively hot, as will the flue gases flowing into the left-hand end of the air preheater (as viewed in FIG. 1). Accordingly, the left-hand end (as viewed in FIG. 1) is referred to as the hot end 40.

Figure 2:
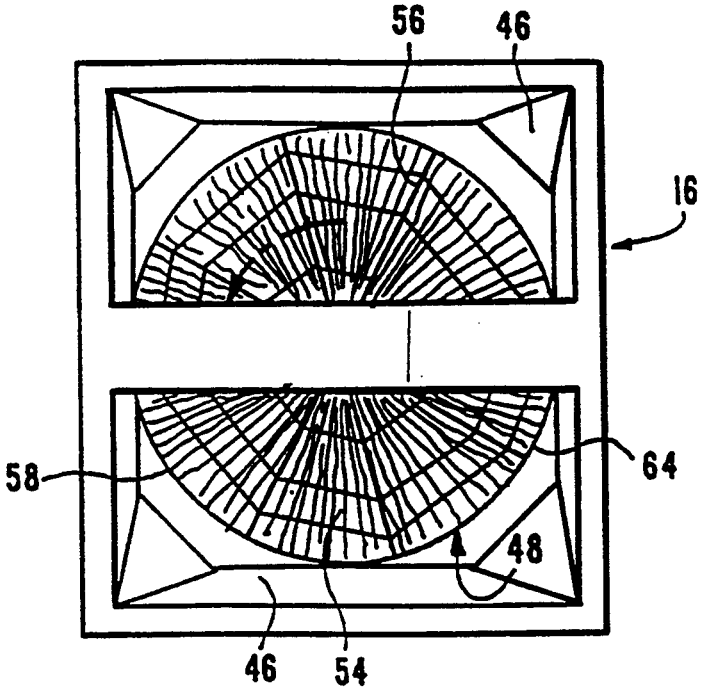
FIG. 2. (PRIOR ART)
FIG. 2 is a plan view of such a typical air heater.
Figure 3:
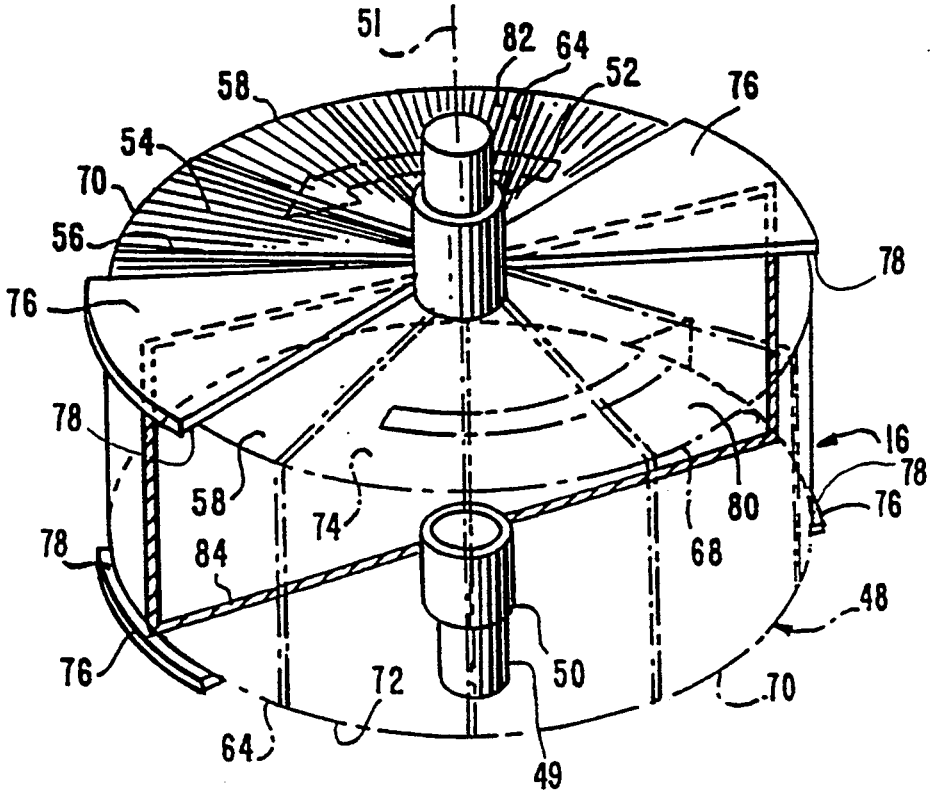
FIG. 3. (PRIOR ART)
FIG. 3 is a schematic, isometric view of the rotor of a typical air heater, which view also shows the sector plates of the housing.

Referring now to FIG. 2, the main portions of conventional air heater 16 include a housing 46 and a rotor or cylindrical drum 48 in the housing. Housing 46 surrounds drum 48. Housing 46 and rotor 48 are rotatable relative to each other about a rotor post or drive axle 49 (FIG. 3). Drive axle 49 defines a central axis 51 of the conventional air heater 16. Drive axle 49 is journaled in a lower bearing assembly 50 and an upper trunnion and bearing assembly 52. Rotor 48 includes sets of heat exchanging elements 54 therein which define a heat exchange matrix. Heat exchanging elements 54 take the form of metallic heat transfer plates 58 normally having a corrugated configuration and maintained in spaced relation to provide passages therebetween for the flow of gasses, e.g. air and flue gasses, axially of the rotor 48. Rotor 48 also includes a plurality of radially extending diaphragms 56 which divide rotor 48 into sectors 58, each sector containing a set of heat exchanging elements 54.

Further, the rotor has a pair of oppositely disposed circular ends 64 adjacent both the hot and cold ends 40, 42 of the air preheater, each circular end being defined by a circular edge 68, 70 of the rotor. The circular ends 64 and circular edges 68, 70 define a hot end 72 and a cold end 74 of the rotor 48, which hot and cold ends correspond respectively to the hot end 40 and cold end 42 of the air preheater 16. Of course, the hot end 72 is the end which receives hot discharge flue gases to be subjected to heat extraction. Hot end 72 is also the end which emits intake air which has been preheated. Likewise, the cold end 74 of rotor 48 is that end which receives intake air for the fuel burning facility, which intake air is to be preheated. Finally, the cold end 74 of rotor 48 is also that end which emits discharge gas from the fuel burning facility, which discharge gas has been subjected to heat extraction and thus cooled.

The housing 46 includes a plurality of sector plates 76, each sector plate having a sealing surface 78 which faces toward the rotor 48. Sector plates 76 divide housing 46 into an air intake half 80 and a gas discharge half 82. The plane 84 representing the boundary between these two halves, 80, 82 is shown in FIG. 3. As is particularly apparent from FIG. 3, there is one pair of sector plates disposed adjacent the hot end 72 of rotor 48 and another pair of sector plates 76 disposed adjacent the cold end 74 of rotor 48. Each sector plate 76 corresponds in configuration to a sector 58 of the drum.

Figure 4:
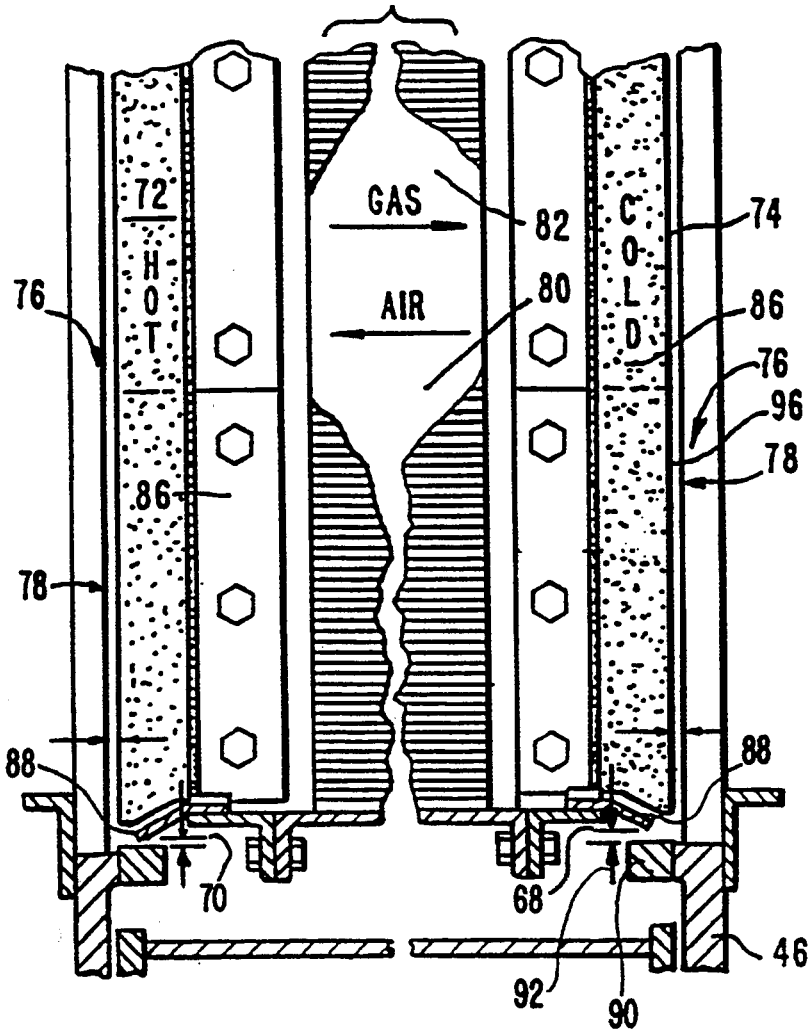
FIG. 4 (PRIOR ART)
FIG. 4 is a fragmentary sectional view through a known air heater showing both the radial and circumferential seal plates typically found as original equipment on conventional air heaters, which circumferential seal plates, at least, are to be replaced by the perimeter seal of the present invention.

Referring to FIG. 4, diaphragms 56 of rotor 48 include a set of semi-rigid radial seal plates 86 coupled therewith. Also coupled with the conventional rotor 48 of FIG. 4 are sets of semi-rigid circumferential seal plates 88 disposed adjacent circular edges 68, 70 the rotor. Corresponding with circumferential seal plates 88, but coupled with the housing 46, are a pair of annular wear bars 90. The conventional air heater 16 is designed with the intention that a small clearance 92 exist between the outer, distal edge of each circumferential seal plate 88 and its associated wear bar 90. In actual practice, however, thermal distortions and dimensional or positional errors will cause the clearance 92 to be excessively large, or will cause the clearance to become nonexistent. In the latter instance, the conventional circumferential seal 88 will clash with the wear bar 90.

Increased temperatures cause the rotor 48 to deform with a partial, approximately spherical curvature, resulting in a convex surface at hot end 72 and a concave surface at cold end 74. Likewise, decreased temperatures cause the drum and radial seals to return to a reduced curvature. Accordingly, the rotor 48 and conventional circumferential seal plates 88 tend either to clash with wear bars 90 or to be moved undesirable distances from wear bars 90. Since these components are conventionally constructed of a generally stiff, semi-rigid metal material, the metal-to-metal contact which will occur upon clashing can be quite disadvantageous and can lead to failures.

Figure 5:
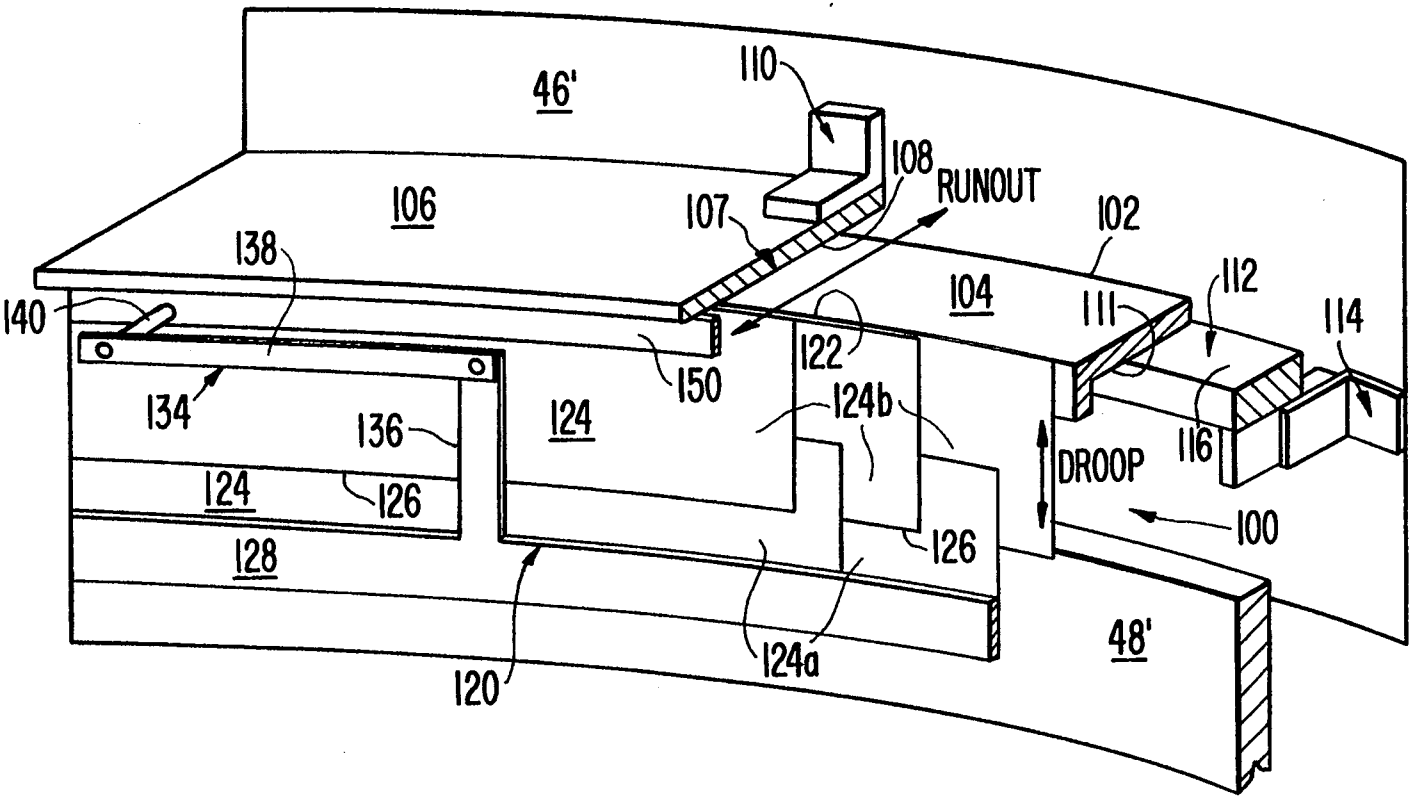
FIG. 5 is a fragmentary isometric view of a perimeter seal arrangement according to the present invention.
Figure 6:
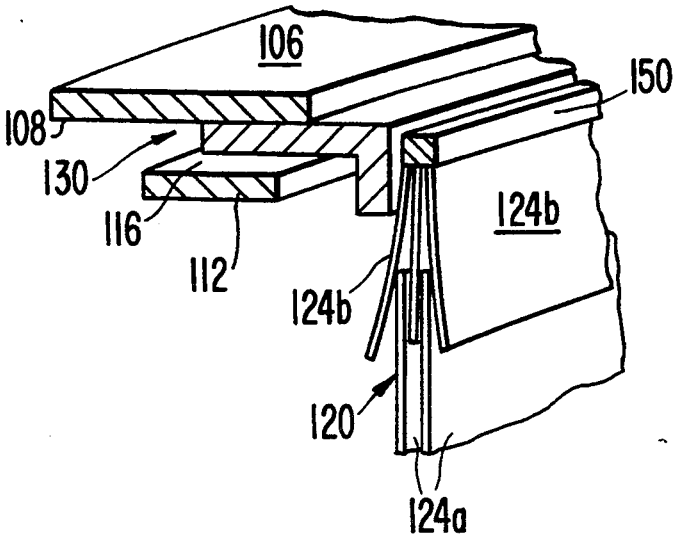
FIG. 6 is a further fragmentary isometric view of a perimeter seal arrangement according to the present invention in which the leaves or strips of the axially slidable, labyrinth seal joint are shown with exaggerated thicknesses for illustrative purposes.
Figure 7:
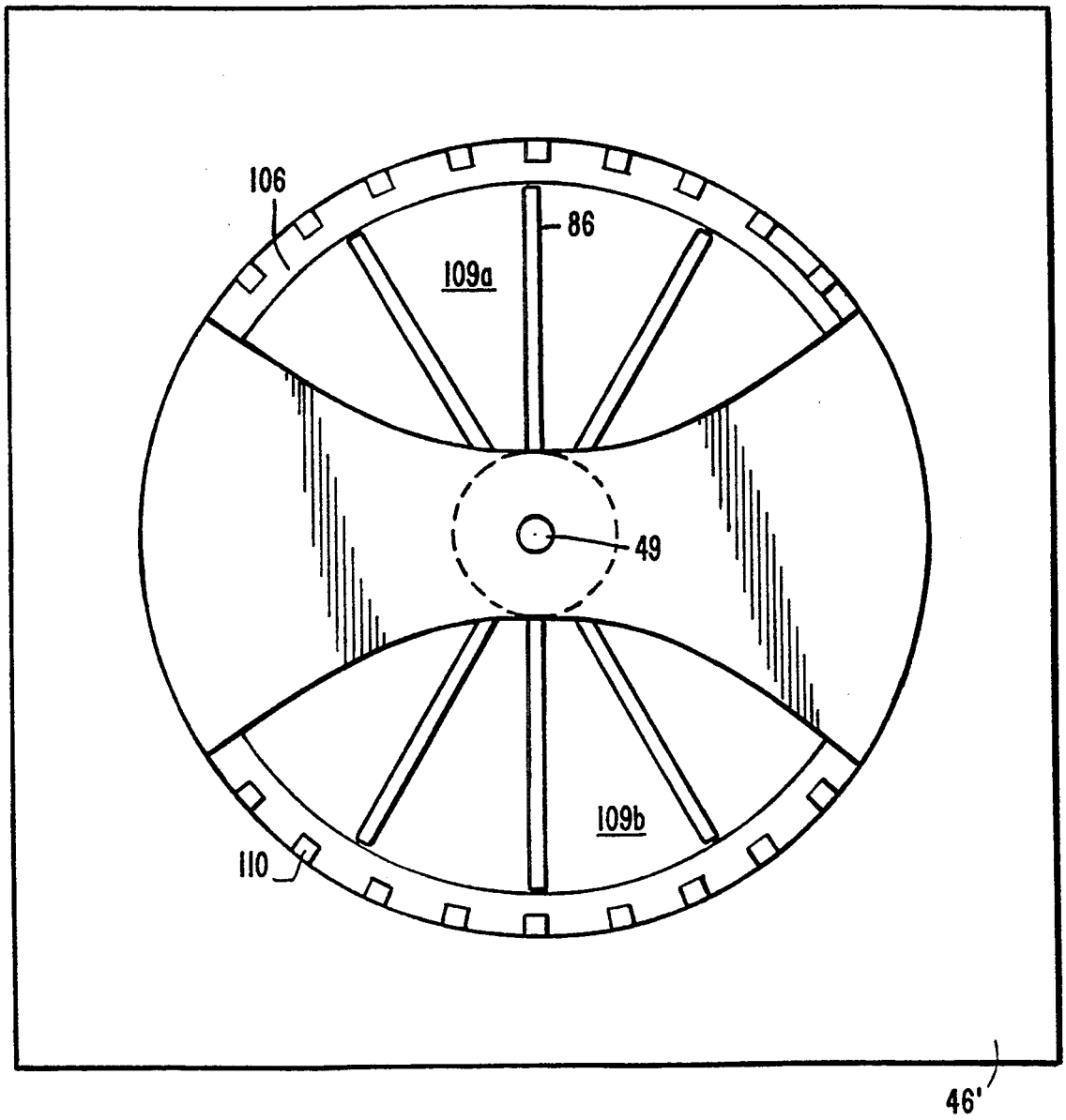
FIG. 7 is a plan view of an air preheater using the seal of the present invention with sector plates which have been exaggerated in size to show the relationship between the sector plates and the seat of the seal arrangement of the present invention.

A sealing system which overcomes the drawbacks of known systems is illustrated in FIGS. 5–7. Referring to FIG. 5, rotor 48' is enclosed by a housing 46'. The cross hatching in FIGS. 5 and 6 indicate which components, according to the preferred embodiment of the invention, are stationary, i.e., which components are coupled with the housing 46' and which components are rotating parts which rotate along with the rotor 48'. The downward-to-the-left sectional hatching designates the rotating parts and the downward-to-the-right hatching designates components which are stationary.

Reference numeral 100 generally refers to a preferred embodiment of the overall seal of the present invention. Seal 100 includes a seal member 102 circumscribing the central axis 51 of the air heater. Seal member 102 has a seal face 104 disposed in a plane perpendicular to central axis 51. Seal 102 is coupled with rotor 48' and moves along with the rotor.

Seal 100 also includes a seat 106 having a seat face 108, which seat face is in the same plane 107 as the sector plate 76 of the air heater 16, and specifically, in the same plane as sealing surfaces 78 of the sector plates 76. Seat 106, which is stationary during operation, is affixed to housing 46' by a seat mounting clip 110. Seat face 108 and seal face 104 are disposed in mutually opposed, face-to-face cooperating relationship to effect sealing of the axial leak path of the air heater while also accommodating radial displacements and radial positioning variations as between housing 46' and rotor 48'. Because seat face 108 is in the same plane as sector plate 76, seat face 108 extends around the housing 46' between the gas and air sections forming in effect a single surface with large, roughly pie shaped gas and air openings 109*a*, 109*b*, as best seen in FIG. 7. That is, the seat 106 extends semi-circularly from one sector plate to the other sector plate so that the seat, combined with the outer regions of the sector plates, form a complete, continuous, closed ring, the surfaces of which provide a continuous and endless annular mating surface for seal face 104.

Seal member 102 includes a rear surface 111 disposed in a plane perpendicular to central axis 51 of air heater 16'. Rear surface 111 faces away from seal face 104 of seal member 102. Rear surface 111 faces a seal track 112 which, in operation, is stationary and which is mounted to housing 46' by track mounting clips 114. Seal track 112 extends 360 degrees around air heater 16' and acts as a guide to keep seal member 102 from moving more than a minimal distance away from seat 106. Seal track 112 includes a track face 116, such that rear surface 111 of seal member 102 and track face 116 of seal track 112 are disposed in mutually opposed, face-to-face, cooperating relationship for accommodating radial displacements and positioning variations as between the housing 46' and rotor 48'. Seal track 112 can itself run 360 degrees around the housing 46' because track 112 is axially spaced from seat 106.

Seal 100 includes a multiple, axially movable slip joint 120 which also acts as a seal against flow of gasses across the joint. Along its axial side 122 slip joint 120 is joined with the seal member 102 and is disposed between seal member 102 and rotor 48'. Slip joint 120 provides a seal against gas flow across joint 120 in a radial direction. Slip joint 120 has freedom of axial movement to accommodate axial displacements and axial position variations as between the seal member 102 and the rotor 48'. This axial freedom, in turn, facilitates maintenance of the face-to-face sealing relationship between seal face 104 and seat face 108. In addition, slip joint 120 seals part of the leak path of the air preheater.

Slip joint 120 includes sets of overlapping strips or leaves 124 of spring material. One set of strips 124*a* is fixed at one side to rotor 48'. Another set of strips 124*b* is affixed at one side with respect to seal member 102. A seal clamp ring 128 clamps axial slip joint 120, and in particular, the upwardly extending plies 124*a* thereof, to the rotor 48'. Another seal clamp ring 150 clamps axial slip joint 120, and in particular, the downwardly extending plies 124*b* thereof, to the seal member 102. The free, distal sides 126 of strips 124 are interengaged in mutually overlapping disposition. The overlapping strips will accommodate axial movements of seal member 102 with respect to rotor 48', while at the same time providing a labyrinth seal against radial leakage of gasses between seal member 102 and rotor 48'. In the particular preferred embodiment shown, there are five strips 124, i.e., five plies, three of which face downwardly in the drawing and two of which face upwardly. Strips or plies 124 are preferably constructed of nickel alloy spring material and are arranged so that they can slip axially with respect to each other without opening a significant leak path.

It will be apparent that, in the above-described arrangement, seal member 102, seal face 104, axial slip joint 120 and seal clamp ring 128 all move together along with rotor 48'. Seat 106 and seal track 112, are axially spaced from each other in parallel planes so as to form therebetween an annular gap 130 shown in FIG. 6. Annular gap 130 extends between the seat face 108 of seat 106 and the track face 116 of seal track 112. Annular gap 130 allows seal member 102 to move along within the gap as rotor 48' rotates. Seat 106 and seal track 112 provide a predictable, allowable clearance between seal member 102 and seat 106.

At any time when the seal member 102 might run virtually perfectly true within gap 130, it is possible that neither the seal face 104 nor the rear surface 111 will engage their mating, stationary faces 108, 116, there being the theoretical possibility of a slight clearance existing at both sides of seal member 102 at the same time. The greater likelihood, however, is that, some of the time, seal face 104 will engage seat face 108, leaving a clearance between rear surface 111 and track face 116, and that, at other times the latter two surfaces will engage each other, and a clearance will exist between seal face 104 and seat face 108. It is also possible that the seal and seat faces 104, 108 will engage each other on one half of the air heater, say for instance the air intake half 80, and the rear surface 111 and track face 116 will engage each other on the other half of the air preheater, say for instance the gas discharge half 82. This can occur as a result of either positional errors, thermal distortions, or both.

It will be apparent that seal member 102 will ride in the annular gap 130 between seat 106 and seal track 112 and will at times move toward and away from each side of the gap. For instance, if the rotor at 48' is drooping away from seat 106, it will be pulling seal member 102 away from seat 106. If the circular rotor edge 68 or 70 is later moving back toward seat 106, the rotor pushes seal member 102 toward the seat 106. When rear surface 111 of seal member 102 contacts track face 116 of seal track 112, there is a small, discreet leak path. When, on the other hand, seal face 104 of seat member 102 contacts seat face 108 of seat 106, there is virtually no leak path in the area of contact.

In the present invention, seal member 102 and axial slip joint 120 will either literally or figuratively replace the conventional circumferential seal 88 which is original equipment on many air heaters. As for the seat 106 and seal track 112, these may replace the conventional wear bar 90, but more often they will simply be attached to the wear bar 90. It will be apparent that conventional air heater 16 has two sets of circumferential seals 88, i.e. one set for each circular edge 68, 70. Thus, in practice, the two conventional sets of circumferential seals will normally be replaced by two sets of peripheral seals according to the present invention, one set being for the hot end 72 and the other set being for the cold end 74.

A drag link 134 extends between seal member 102 and rotor 48' to rigidly fix seal member 102 against circumferential slipping movement with respect to rotor 48' while allowing axial movement of seal member 102 with respect to the rotor. That is, drag link 134 ensures that overlapping strips 124 will not slip circumferentially with respect to each other, which in turn ensures that seal member 102 travels circumferentially with the rotor without slipping. The drag link includes a rigid arm 136 extending axially from seal clamp ring 128 and pivotally joined to a linking arm 138 which arm, in turn, is free to pivot about a post 140. Post 140 is rigidly affixed with respect to seal member 102. It will be seen from the foregoing that seal clamp ring 128 serves a dual purpose, i.e., it clamps one half of the axial slip joint 120 to the rotor 48', and it also provides a tractive attachment of the drag link 134 to the rotor.

Seat 106 is wide enough in the radial direction to accommodate any anticipated positional errors or thermal displacements. During installation, seat 106 is simply clamped in position in the housing 46', and then seat mounting clips 110 are held in place and then welded. Then the seam between seat 106 and housing 46' is caulked to prevent leakage. Caulking is also used around the seal clamp ring 128 to prevent leakage in the area where the axial slip joint 120 is joined to rotor 48'.

It will be apparent from the foregoing description and from the drawings that the present invention provides for sealing of an air heater through separation of the radial and axial components of undesirable displacements. These displacements occur between the rotor 48' and surrounding housing 46' as a result of built-in positioning and dimensioning errors and as a result of thermal deflections. The present invention makes the sealing with respect to these radial and axial displacements totally independent of each other. Axial displacements are accommodated through axial sliding leaf seal joint 120. Radial displacements are accommodated by seal member 102, which has a wide enough seal face 104 so that radial positioning errors, radial dimensioning errors, or radial movements due to thermal expansions or contractions result simply in the mating surfaces 102, 104 being in slightly different relative radial locations.

The invention has been described by way of a preferred embodiment, and it will be understood that many variations and modifications are possible. Thus, the invention is not limited by the foregoing description, but rather encompasses many embodiments and variations within the scope of the appended claims.

What is claimed is:

1. A seal for an air heater, the air heater having first and second main elements, the main elements including a rotatable element which rotates about a central axis of the air heater and a stationary element which is coaxially disposed with respect to the rotatable element, the air heater having a leak path between the elements, the seal comprising:

a. a seal member circumscribing the central axis of the air heater, said seal member having a seal face disposed in a plane perpendicular to the central axis of the air heater, said seal member being coupled with the first main element of the air heater;

b. a seat also circumscribing the central axis of the air heater, said seat having a seat face disposed in a plane perpendicular to the central axis of the air heater, said seat being coupled with the second main element of the air heater, said seat face and said seal face being disposed in mutually opposed, face-to-face, cooperating relationship to effect sealing of the leak path of the air heater while also accommodating radial displacements and radial position variations between the rotatable and stationary main elements of the air heater; and c. an axially moveable joint coupled with said seal member and disposed axially between said seal member and the first main element of the air heater, said joint being sealed against gas flow across said joint in a radial direction with respect to the central axis of the air heater, said joint having freedom of axial movement to accommodate axial displacements and axial position variations as between said seal member and the first main air heater element, which axial freedom of movement in turn facilitates maintenance of the face-to-face sealing relationship between said seal face and said seat face.

2. A seal as claimed in claim 1 further including:

a. a rear surface on said seal member, said rear surface being disposed in a plane perpendicular to the central axis of the air heater, said rear surface facing away from said seal face of said seal member;

b. a seal track having a track face disposed in a plane perpendicular to the central axis of the air heater, said seal track being coupled with the second main element of the air heater, said rear surface and said track face being disposed in mutually opposed, face-to-face, cooperating relationship for limiting the extent to which the seal face may move axially away from said seat face and for accommodating radial displacements and radial positioning variations as between the rotatable and stationary main elements of the air heater.

3. An air heater as claimed in claim 2, wherein said seat and said seal track are axially spaced from each other in parallel planes so as to form an annular gap therebetween, said annular gap extending between said seat face of said seat and said track face of said seal track, said seal member being disposed in said annular gap for accommodating relative rotational movement of the seal member with respect to the gap as the main air heater elements move relative to each other, whereby either the seal face of the seal member may engage the seat on one side of the gap or, alternatively, the rear surface of the seal member may engage the track face of the seal track on the other side of the gap depending upon the direction and extent of relative axial displacements of the main air heater elements or depending upon the direction and extent of axial positioning discrepancies of the main air heater elements to be accommodated.

4. A seal as claimed in claim 3, wherein the first main element of the air heater is a rotor containing heat exchange elements, wherein the second main air heater element is a stationary housing surrounding the rotor, and wherein said seal track is rigidly coupled to said housing in a position radially inwardly spaced from the housing by a set of track mounting clips extending radially between said seal track and the housing, said radial spacing of said seal track from said housing forming an open, annular space between said seal track and the housing to prevent accumulation of foreign material in said gap.

5. A seal as claimed in claim 1 wherein said joint includes sets of overlapping strips of spring material, one set of strips being fixed at one side thereof to the first main air heater element, another set of strips being affixed at one side thereof with respect to the seal member, the other sides of the sets of strips being interengaged in mutually overlapping disposition to accommodate axial movement of said seal member with respect to the first main air heater element while at the same time providing a seal against radial leakage of gases between said seal member and the first main air heater element.

6. A seal as defined in claim 5 including a drag link mechanism extending between said seal member and the first main air heater element to rigidly fix the seal member against circumferential slipping movement with respect to the first main air heater element while allowing axial movement therebetween.

7. A seal for an air heater, the air heater having first and second main elements, the main elements including a rotatable element which rotates about a central axis of the air heater and a stationary element which is coaxially disposed with respect to the rotatable element, the air heater having a leak path between the elements, the seal comprising:

a. seal member circumscribing the central axis of the air heater, said seal member having a seal face disposed in a plane perpendicular to the central axis of the air heater, said seal member being coupled with the first main element of the air heater;

b. a seat also circumscribing the central axis of the air heater, said seat having a seat face disposed in a plane perpendicular to the central axis of the air heater, said seat being coupled with the second main element of the air heater, said seat face and said seal face being disposed in mutually opposed, face-to-face, cooperating relationship, to effect sealing of the leak path of the air heater while also accommodating radial displacements and radial position variations between the rotatable and stationary main elements of the air heater;

c. an axially moveable joint coupled with said seal member and disposed axially between said seal member and the first main element of the air heater, said joint being sealed against gas flow across said joint in a radial direction with respect to the central axis of the air heater, said joint having freedom of axial movement to accommodate axial displacements and axial position variations as between said seal member and the first main air heater element, which axial freedom of movement in turn facilitates maintenance of the face-to-face sealing relationship between said seal face and said seat face;

d. a rear surface on said seal member, said rear surface being disposed in a plane perpendicular to the central axis of the air heater, said rear surface facing away from said seal face of said seal member; and e. a seal track having a track face disposed in a plane perpendicular to the central axis of the air heater, said seal track being coupled with the second main element of the air heater, said rear surface and said track face being disposed in mutually opposed, face-to-face, cooperating relationship for limiting the extent to which the seal face may move axially away from said seat face and for accommodating radial displacements and radial positioning variations as between the rotatable and stationary main elements of the air heater.

* * * * *